US009855736B2

(12) United States Patent
Shigeta

(10) Patent No.: US 9,855,736 B2
(45) Date of Patent: Jan. 2, 2018

(54) MODULE-TYPE PROCESSING UNIT AND TOTALLY AUTOMATED MANUFACTURING SYSTEM FOR GRAVURE CYLINDER USING SAME

(71) Applicant: THINK LABORATORY CO., LTD., Chiba (JP)

(72) Inventor: Tatsuo Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 0 days.

(21) Appl. No.: 15/124,864

(22) PCT Filed: Feb. 19, 2015

(86) PCT No.: PCT/JP2015/054528
§ 371 (c)(1),
(2) Date: Sep. 9, 2016

(87) PCT Pub. No.: WO2015/137072
PCT Pub. Date: Sep. 17, 2015

(65) Prior Publication Data

US 2017/0021608 A1 Jan. 26, 2017

(30) Foreign Application Priority Data

Mar. 11, 2014 (JP) ..... 2014-047240

(51) Int. Cl.
*B41M 1/00* (2006.01)
*B41F 3/54* (2006.01)
(Continued)

(52) U.S. Cl.
CPC ..... *B41F 3/54* (2013.01); *B41C 1/00* (2013.01); *B41C 1/18* (2013.01); *B41N 1/06* (2013.01); *B41N 1/16* (2013.01)

(58) Field of Classification Search
CPC ..... B41C 1/00
(Continued)

(56) References Cited

U.S. PATENT DOCUMENTS 4,163,454 A * 8/1979 Shigeta ..... B41C 1/18 134/160
5,201,951 A * 4/1993 Shigeta ..... B05C 1/022 118/218
(Continued)

FOREIGN PATENT DOCUMENTS

EP 2623320 A1 8/2013
EP 2769844 A1 8/2014
(Continued)

*Primary Examiner* — Anthony Nguyen
(74) *Attorney, Agent, or Firm* — McGlew and Tuttle, P.C.

(57) ABSTRACT

Provided are a modular processing unit that is standardizable, capable of enhancing production efficiency, and is also flexibly customizable, and a fully automatic gravure cylinder manufacturing system using the modular processing unit. The modular processing unit includes a pair of frame members provided upright so as to face each other, a first processing module including a first processing bath module, a first beam module provided horizontal to a floor, and a first chuck module, and a second processing module including a second processing bath module, a second beam module provided horizontal to the floor, and a second chuck module. The modular processing unit has multi-stage structure with at least the first processing module and the second processing module being assembled onto the frame members.

7 Claims, 7 Drawing Sheets

(51) Int. Cl.

| | |
|---|---|
| ***B41C 1/00*** | (2006.01) |
| ***B41C 1/18*** | (2006.01) |
| ***B41N 1/06*** | (2006.01) |
| ***B41N 1/16*** | (2006.01) |

(58) Field of Classification Search
USPC ..... 101/170
See application file for complete search history.

(56) References Cited

U.S. PATENT DOCUMENTS

| | | | | |
|---|---|---|---|---|
| 6,076,464 | A * | 6/2000 | Okamura | B41F 27/1287 101/401.1 |
| 6,660,139 | B1 * | 12/2003 | Sendai | H01L 21/2885 118/428 |
| 7,814,831 | B2 * | 10/2010 | Wientjens | B41F 5/24 101/219 |
| 2005/0100826 | A1 * | 5/2005 | Sato | B41C 1/00 430/307 |
| 2006/0065533 | A1 * | 3/2006 | Inoue | B41N 3/034 205/81 |
| 2009/0017733 | A1 * | 1/2009 | Takahashi | B24B 9/065 451/57 |
| 2013/0160947 | A1 | 6/2013 | Shigeta | |
| 2014/0055825 | A1 | 2/2014 | Shigeta | |

FOREIGN PATENT DOCUMENTS

| | | | |
|---|---|---|---|
| JP | 2004-223751 | A | 8/2004 |
| JP | 2004-225111 | A | 8/2004 |
| JP | 2004-232028 | A | 8/2004 |
| WO | 2012/043515 | A1 | 4/2012 |
| WO | 2013/058151 | A1 | 4/2013 |

* cited by examiner

MODULE-TYPE PROCESSING UNIT AND TOTALLY AUTOMATED MANUFACTURING SYSTEM FOR GRAVURE CYLINDER USING SAME

TECHNICAL FIELD

The present invention relates to a modularized processing unit and a fully automatic gravure cylinder manufacturing system using the modularized processing unit.

BACKGROUND ART

Hitherto, as gravure plate-making plants for manufacturing gravure cylinders (also referred to as "gravure plate-making rolls"), gravure plate-making plants described in Patent Documents 1 to 3 have been known.

As can be seen from the drawings of Patent Documents 1 to 3, a manufacturing line for a gravure plate-making roll has hitherto been constructed of an industrial robot and a stacker crane used in combination.

In the manufacturing line using the stacker crane, processing is performed in each of various processing units under a state in which an unprocessed plate-making roll is chucked by the stacker crane with use of a cassette-type roll chuck rotary transportation unit.

In the manufacturing line using the stacker crane, however, the unprocessed plate-making roll is sequentially transferred to the various processing units under the state in which the unprocessed plate-making roll is chucked with use of the cassette-type roll chuck rotary transportation unit. As a result, there is a problem in that a longer period of time is required due to the operation described above.

In addition, in the manufacturing line using the stacker crane, the unprocessed plate-making roll is sequentially transferred to the processing units under the state in which the unprocessed plate-making roll is chucked with use of the cassette-type roll chuck rotary transportation unit, and hence the various processing units need to be juxtaposed to one another. As a result, there is a problem in that a large installation space is required for the processing units.

Further, in the manufacturing line using the stacker crane, the unprocessed plate-making roll is sequentially transferred to the various processing units under the state in which the unprocessed plate-making roll is chucked with use of the cassette-type roll chuck rotary transportation unit. As a result, there is a problem in that dust may be generated.

In view of those problems, a fully automatic gravure plate-making processing system described in Patent Document 4 has been proposed and favorably accepted. The fully automatic gravure plate-making processing system has high degrees of freedom, and is capable of manufacturing a gravure plate-making roll more quickly than in the prior art, achieving space saving, performing an unattended operation even in the nighttime, flexibly customizing a manufacturing line, and satisfying various customer needs.

In this prior art fully automatic gravure plate-making processing system, a two-stage processing unit including, for example, a copper plating apparatus on a lower stage and a degreasing apparatus on an upper stage is disclosed as the processing unit. FIG. 8 is a side view for illustrating the processing unit used in the prior art fully automatic gravure plate-making processing system. In FIG. 8, a two-stage processing unit 200 being the prior art processing unit includes a copper plating apparatus 202 on a lower stage and a degreasing apparatus 204 on an upper stage. Reference symbol 206 represents a storage tank configured to store a plating solution, a degreasing solution, a resist removal solution, or other solutions. Lid portions 208 and 210 configured to close openings for loading and unloading unprocessed rolls are provided to the lower-stage processing apparatus and the upper-stage processing apparatus, respectively.

In the two-stage processing unit of the prior art fully automatic gravure plate-making processing system as described above, the lower-stage processing apparatus and the upper-stage processing apparatus have independent frames, and hence the two-stage processing unit is constructed by assembling each of the apparatus and mounting the upper-stage apparatus on the lower-stage apparatus. When the lower-stage processing apparatus and the upper-stage processing apparatus have independent frames, however, the processing unit cannot be standardized, and the production efficiency is poor as well.

When further flexible customization of the fully automatic gravure plate-making processing system is pursued but the sizes of the processing units are set variously, there is a problem of difficulty in the customization.

PRIOR ART DOCUMENTS

Patent Document

Patent Document 1: JP 2004-223751 A
Patent Document 2: JP 2004-225111 A
Patent Document 3: JP 2004-232028 A
Patent Document 4: WO 2012/043515 A1

SUMMARY OF THE INVENTION

Problems to be Solved by the Invention

The present invention has been made in view of the above-mentioned circumstances of the prior art, and it is therefore an object thereof to provide a modular processing unit that is standardizable, capable of enhancing production efficiency, and is also flexibly customizable, and to provide a fully automatic gravure cylinder manufacturing system using the modular processing unit.

Means for Solving Problems

In order to solve the above-mentioned problems, according to one embodiment of the present invention, there is provided a modular processing unit to be used for a fully automatic gravure cylinder manufacturing system, the fully automatic gravure cylinder manufacturing system including: at least two industrial robots; and a plurality of processing units installed within a handling range of at least one of the at least two industrial robots, the fully automatic gravure cylinder manufacturing system being configured such that an unprocessed roll is gripped by a robotic arm to be sequentially transferred to and processed by each of the plurality of processing units, the modular processing unit including: a pair of frame members provided upright so as to face each other; a first processing module including: a first processing bath module configured to receive the unprocessed roll to perform plate-making processing; a first beam module provided horizontal to a floor; and a first chuck module mounted on the first beam module, the first chuck module including a pair of chuck cones configured to grip both ends of the unprocessed roll so that the unprocessed roll is received in the first processing bath module; and a second processing module including: a second processing bath module configured to receive the unprocessed roll to perform plate-making processing; a second beam module provided horizontal to the floor; and a second chuck module mounted on the second beam module, the second chuck module including a pair of chuck cones configured to grip both the ends of the unprocessed roll so that the unprocessed roll is received in the second processing bath module, the modular processing unit having multi-stage structure with at least the first processing module and the second processing module being assembled onto the pair of frame members.

It is preferred that at least one of the pair of chuck cones mounted on each of the first chuck module and the second chuck module be slidable relative to each of the first beam module and the second beam module so that the pair of chuck cones are freely brought closer to or away from each other.

It is preferred that the each of the first chuck module and the second chuck module include frame portions, which are configured to support the pair of chuck cones, and are provided orthogonal to the each of the first beam module and the second beam module and horizontal to the floor, respectively.

It is preferred that the pair of chuck cones of the each of the first chuck module and the second chuck module be rotatable through intermediation of spindle portions, respectively, and that the modular processing unit further include an energization metal member, which is brought into abutment against at least one of the spindle portions of the each of the first chuck module and the second chuck module, and is energizable with a current via a bus bar.

According to one embodiment of the present invention, there is provided a fully automatic gravure cylinder manufacturing system using the above-mentioned modular processing unit, the fully automatic gravure cylinder manufacturing system including: at least two industrial robots; and a plurality of the modular processing units installed within a handling range of at least one of the at least two industrial robots, the fully automatic gravure cylinder manufacturing system being configured such that an unprocessed roll is gripped by a robotic arm to be sequentially transferred to and processed by each of the plurality of the modular processing units.

According to one embodiment of the present invention, there is provided a method of manufacturing a gravure cylinder, which uses the above-mentioned fully automatic gravure cylinder manufacturing system.

According to one embodiment of the present invention, there is provided a gravure cylinder, which is manufactured with use of the above-mentioned fully automatic gravure cylinder manufacturing system.

Advantageous Effects of the Invention

According to the present invention, it is possible to achieve a remarkable effect of providing the modular processing unit that is standardizable, capable of enhancing the production efficiency, and is also capable of being flexibly customizable, and of providing the fully automatic gravure cylinder manufacturing system using the modular processing unit.

In addition, two steps such as a combination of nickel plating and copper plating, a combination of resist removal and etching, or a combination of degreasing and copper plating are modularized into a single processing unit to provide integrated frame structure. Accordingly, it is possible to achieve a remarkable effect of enhancing compactness and accuracy.

Further, the standardization enables common use of the frame members and the modules such as the beam modules, which cannot ever be achieved in the prior art. Accordingly, it is possible to reduce the cost and enhance the production efficiency.

DESCRIPTION OF THE EMBODIMENTS

Embodiments of the present invention are described below, but those embodiments are described as examples, and hence it is understood that various modifications may be made thereto without departing from the technical spirit of the present invention.

A modular processing unit according to the present invention is described with reference to the accompanying drawings.

Figure 1:
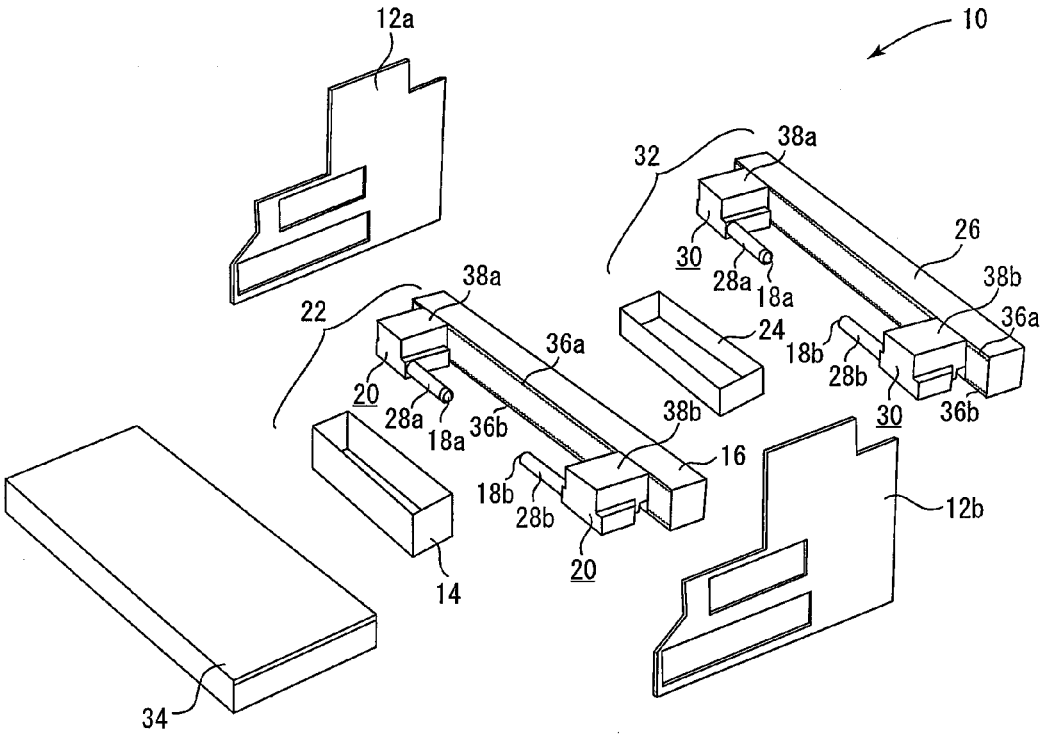
FIG. 1 is a schematic exploded perspective view for illustrating a modular processing unit according to an embodiment of the present invention.
Figure 2:
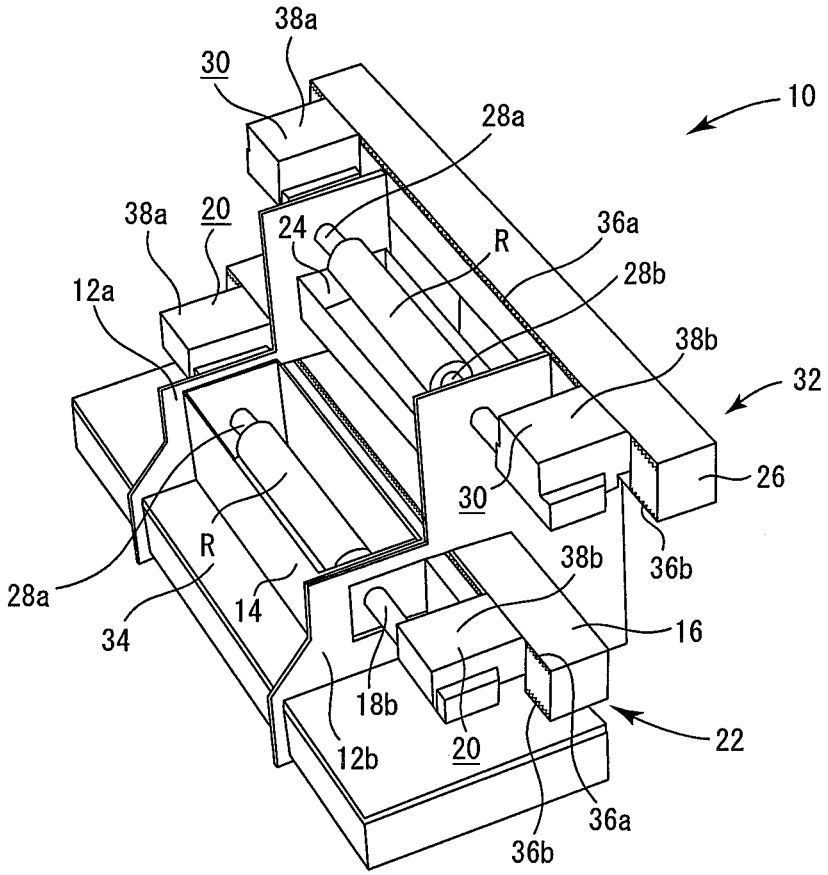
FIG. 2 is a schematic perspective view for illustrating a state in which the modular processing unit of FIG. 1 is assembled.
Figure 3:
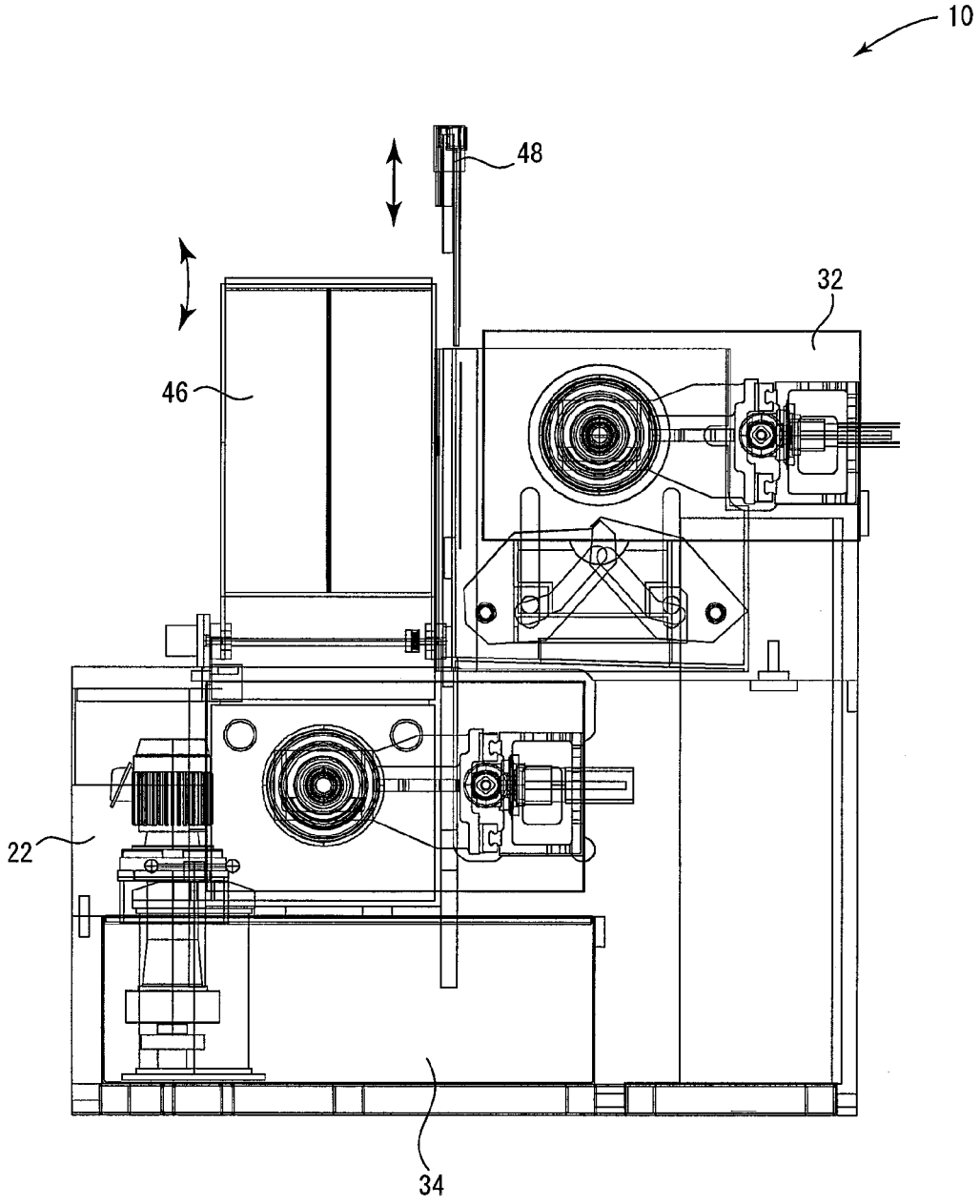
FIG. 3 is a side view for illustrating the modular processing unit according to the embodiment of the present invention.

In FIG. 1 to FIG. 3, reference symbol 10 represents a modular processing unit according to an embodiment of the present invention. The modular processing unit 10 includes a pair of frame members 12*a* and 12*b* provided upright so as to face each other, a first processing module 22 including a first processing bath module 14 configured to receive an unprocessed roll R to perform plate-making processing, a first beam module 16 provided horizontal to a floor, and a first chuck module 20 mounted on the first beam module 16, including a pair of chuck cones 18*a* and 18*b* configured to grip both ends of the unprocessed roll so that the unprocessed roll is received in the first processing bath module 14, and a second processing module 32 including a second processing bath module 24 configured to receive the unprocessed roll to perform plate-making processing, a second beam module 26 provided horizontal to the floor, and a second chuck module 30 mounted on the second beam module 26, including a pair of chuck cones 18*a* and 18*b* configured to grip both the ends of the unprocessed roll so that the unprocessed roll is received in the second processing bath module. The modular processing unit 10 has multi-stage structure with at least the first processing module 22 and the second processing module 32 being assembled onto the frame members 12*a* and 12*b*. Reference symbol 34 represents a storage tank configured to store a plating solution, a degreasing solution, a resist removal solution, or other processing solutions.

In the example of FIG. 1 to FIG. 3, two-stage structure having the first processing module 22 positioned on a lower stage and the second processing module 32 positioned on an upper stage is illustrated as the multi-stage structure of the modular processing unit 10. In the example of FIG. 1 to FIG. 3, the first processing bath module 14 of the first processing module 22 positioned on the lower stage has a deeper bath than the second processing bath module 24 of the second processing module 32 positioned on the upper stage. Therefore, it is suitable that a processing unit configured to perform a plating step or other steps be positioned on the lower stage as the first processing module 22.

At least one of the pair of chuck cones 18*a* and 18*b* mounted on each of the first chuck module 20 and the second chuck module 30 is slidable relative to each of the first beam module 16 and the second beam module 26 so that the pair of chuck cones 18*a* and 18*b* are freely brought closer to or away from each other.

In the example of FIG. 1 to FIG. 3, the pair of chuck cones 18*a* and 18*b* mounted on each of the first chuck module 20 and the second chuck module 30 has the following configuration. Each of the first chuck module 20 and the second chuck module 30 slides along slide rails 36*a* and 36*b* of each of the first beam module 16 and the second beam module 26 so that the pair of chuck cones 18*a* and 18*b* are freely brought closer to or away from each other. When necessary, for example, the chuck cone 18*a* alone may be set slidable while the chuck cone 18*b* is stationary, or the chuck cone 18*b* alone may be set slidable while the chuck cone 18*a* is stationary, that is, one of the chuck cones is set stationary. With this configuration, the pair of chuck cones 18*a* and 18*b* may freely be brought closer to or away from each other. When one of the chuck cones is set stationary, there is no need to secure its drive unit and power supply, thereby providing an advantage that the total width of the processing unit is reduced.

In each of the first chuck module 20 and the second chuck module 30, frame portions 38*a* and 38*b* configured to support the pair of chuck cones 18*a* and 18*b* through intermediation of spindle portions 28*a* and 28*b* in a rotatable manner are provided orthogonal to each of the first beam module 16 and the second beam module 26 and horizontal to the floor, respectively.

The beam that is each of the first beam module 16 and the second beam module 26 is provided as described above to set a standard. Therefore, portions enabling axial movement of the right and left spindle portions 28*a* and 28*b* are located on a single beam, thereby being capable of maintaining high accuracy. Further, there is an advantage that the accuracy of assembling of parts when constructing the processing unit is enhanced.

Due to the multi-stage structure, a third processing module may further be assembled onto the above-mentioned second processing module 32. For example, a paper polishing apparatus or any other apparatus may be provided as the third processing module and assembled onto the second processing module 32.

Figure 8:
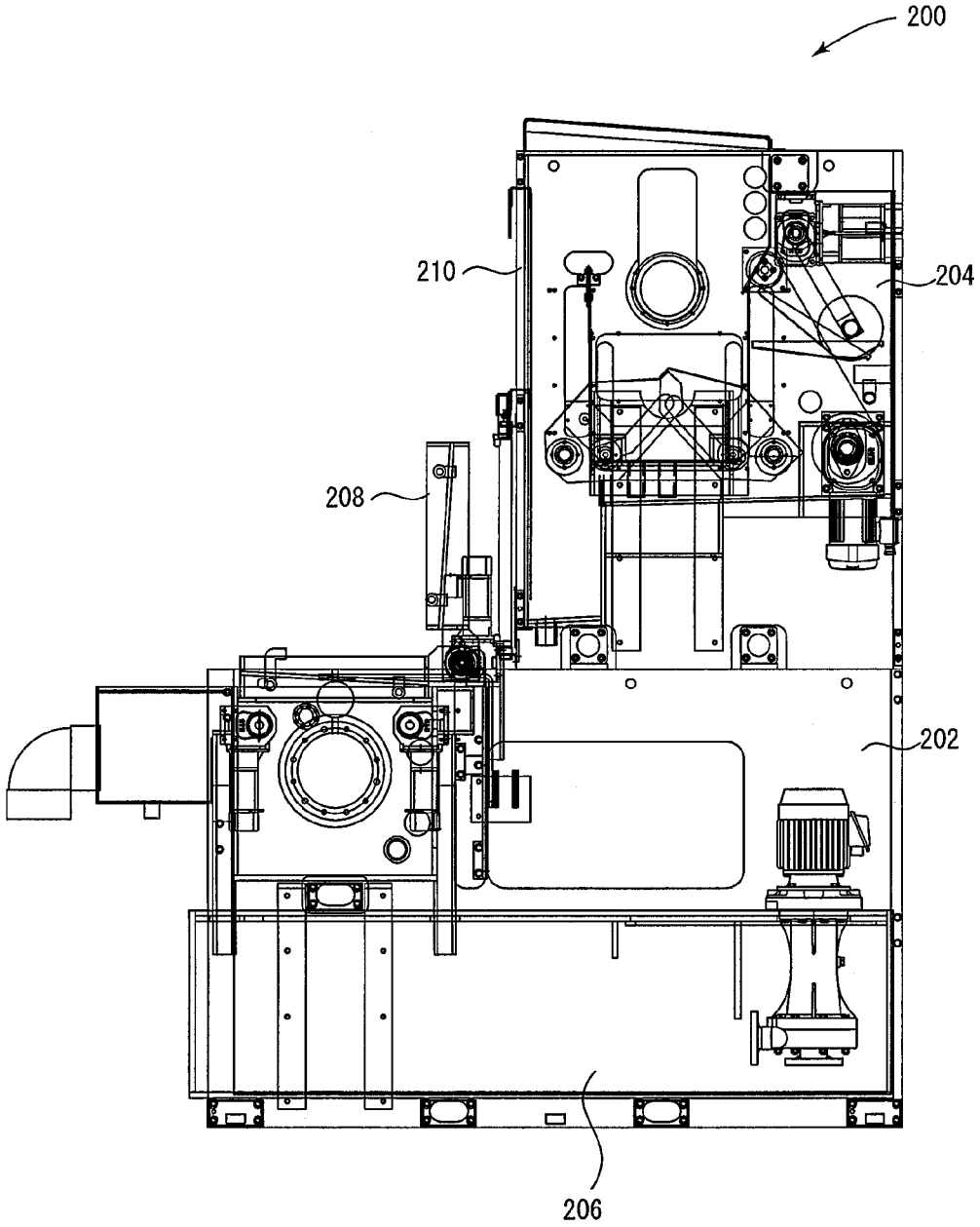
FIG.8 Prior Art
FIG. 8 is a side view for illustrating a prior art processing unit.

FIG. 3 is a side view for illustrating the modular processing unit 10. The modular processing unit 10 may include, for example, a copper plating apparatus as the first processing module 22 positioned on the lower stage, and a degreasing apparatus as the second processing module 32 positioned on the upper stage. Compared to the two-stage processing unit 200 being the prior art processing unit illustrated in FIG. 8, it is understood that the height of the processing unit is reduced by about 25%. Lid portions 46 and 48 configured to close openings for loading and unloading the unprocessed rolls are provided to the first processing module 22 positioned on the lower stage and the second processing module 32 positioned on the upper stage, respectively. In the example of FIG. 3, a state in which the lid portions 46 and 48 are opened is illustrated.

Thus, the compactness can be enhanced through the reduction in height, and high-speed plating and power saving can be realized. Accordingly, excellent cost performance is achieved.

Figure 4:
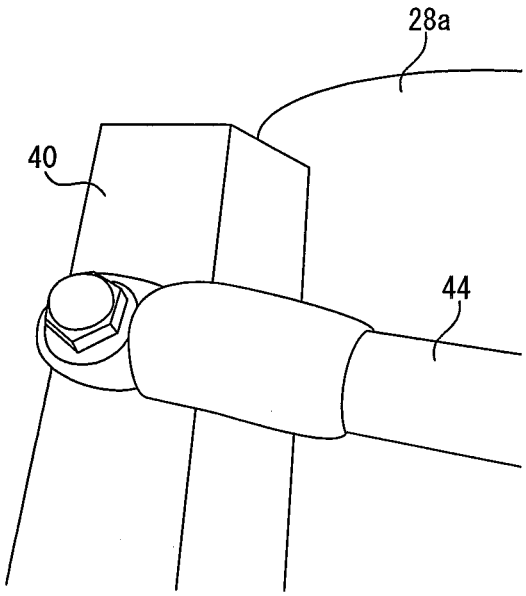
FIG. 4 is a schematic main part enlarged view for illustrating a state in which an energization metal member is brought into abutment against a spindle portion of the modular processing unit according to the present invention.
Figure 5:
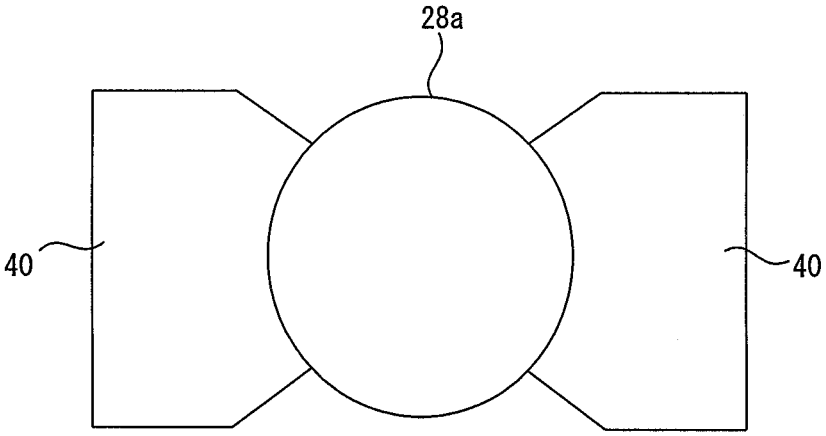
FIG. 5 is a schematic side view of FIG. 4.
Figure 6:
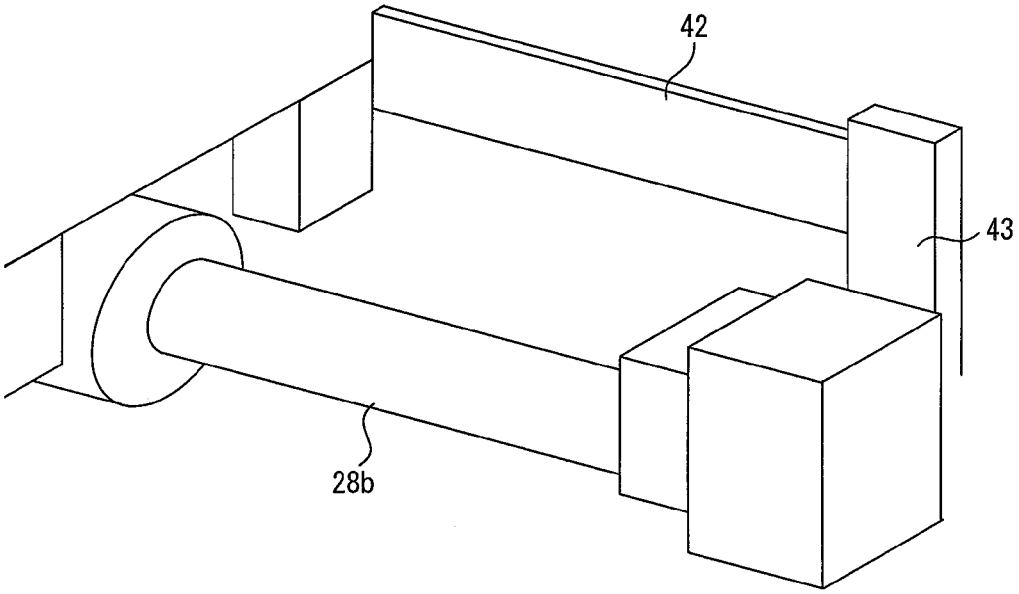
FIG. 6 is a schematic main part enlarged view for illustrating a state in which a bus bar and the energization metal member are connected to each other with a clamp.

The chuck cones 18*a* and 18*b* of each of the first chuck module 20 and the second chuck module 30 are rotatable through intermediation of the spindle portions 28*a* and 28*b*, respectively. As illustrated in FIG. 4 to FIG. 6, an energization metal member 40 may be brought into abutment against at least one of the spindle portions 28*a* and 28*b* of each of the first chuck module 20 and the second chuck module 30 and energized with a current via a bus bar 42. In FIG. 4, reference symbol 44 represents an electric cable extending from a rectifier and being configured to supply, to the energization metal member 40, a DC voltage obtained by converting an AC voltage from an AC power supply. Reference symbol 43 represents a metal clamp connecting the bus bar 42 and the energization metal member 40 to each other. In this manner, the energization metal member 40 is energized with a current via the bus bar 42 as illustrated in FIG. 6, thereby eliminating the need to lay a power cable or other cables on the floor at the periphery of the processing unit. As a result, there is an advantage that the degree of freedom of layout is further enhanced. As a material for each of the energization metal member 40 and the bus bar 42, copper may be used suitably.

Next, a fully automatic gravure cylinder manufacturing system using the above-mentioned modular processing unit 10 is described with reference to the accompanying drawings.

Figure 7:
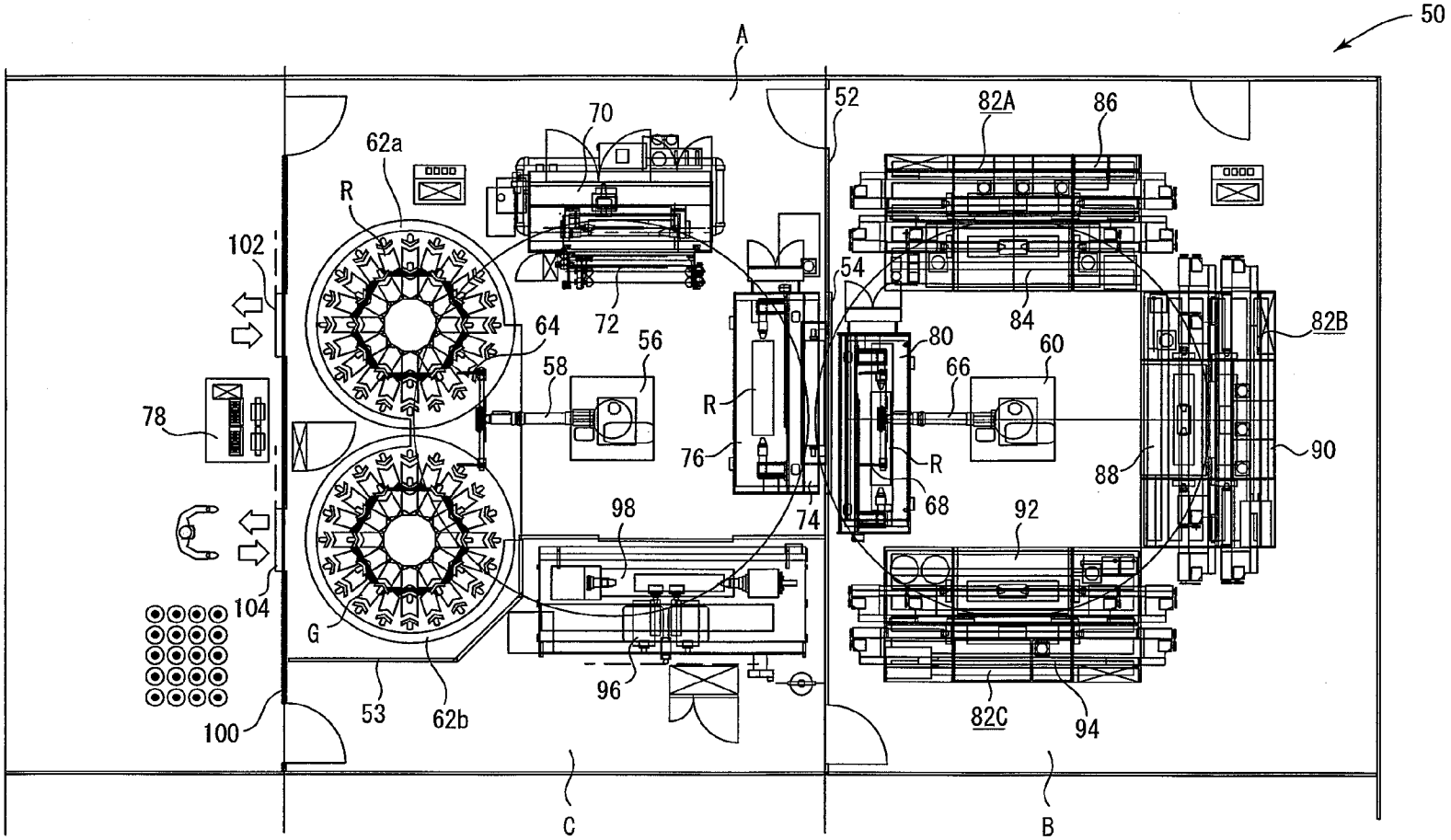
FIG. 7 is a schematic plan view for illustrating a fully automatic gravure cylinder manufacturing system using the modular processing unit according to an embodiment of the present invention.

In FIG. 7, reference symbol 50 represents the fully automatic gravure cylinder manufacturing system according to the present invention.

The fully automatic gravure cylinder manufacturing system 50 includes at least two industrial robots, and a plurality of modular processing units are installed within a handling range of at least one of the industrial robots so that an unprocessed roll is gripped by a robotic arm to be sequentially transferred to and processed by each of the modular processing units.

The fully automatic gravure cylinder manufacturing system 50 is roughly divided into a processing room-A and a processing room-B. The processing room-A is further provided with a processing room-C. The processing room-A and the processing room-B are partitioned by a wall 52, whereas the processing room-A and the processing room-C are partitioned by a wall 53. Further, the pair of the processing room-A and the processing room-B and the pair of the processing room-A and the processing room-C are communicable to each other through freely openable and closable shutters 54, respectively.

A configuration of the processing room-A is described. In the processing room-A, reference symbol 56 represents a first industrial robot, which includes a freely turnable multi-axis robotic arm 58.

Reference symbol R represents an unprocessed roll, and reference symbols 62*a* and 62*b* represent roll stock apparatus, respectively. As the roll stock apparatus, for example, the roll stock apparatus disclosed in Patent Documents 1 to 4 may be used.

Chuck means 64 is provided at a distal end of the robotic arm 58. The chuck means 64 is capable of chucking the unprocessed roll R in a freely releasable manner.

Next, a configuration of the processing room-B is described. In the processing room-B, reference symbol 60 represents a second industrial robot, which includes a freely turnable multi-axis robotic arm 66.

Chuck means 68 is provided at a distal end of the robotic arm 66. The chuck means 68 is capable of chucking the unprocessed roll R in a freely releasable manner.

Reference symbol 70 represents a photosensitive film coating apparatus, and reference symbol 72 represents a laser exposure apparatus. In the example shown in the accompanying drawings, there is employed a configuration similar to that of the prior art two-stage processing unit, in which the photosensitive film coating apparatus 70 is provided above the laser exposure apparatus 72. As those apparatus, publicly known apparatus are applicable. In the example shown in the accompanying drawings, the publicly known photosensitive film coating apparatus and the publicly known laser exposure apparatus are applied, but a modularized processing unit may be employed as illustrated in FIG. 1 to FIG. 3.

Reference symbol 74 represents a roll transfer placement table, on which the unprocessed roll R is placeable for transfer. The roll transfer placement table 74 is provided at a position at which a handling area of the first industrial robot 56 and a handling area of the second industrial robot 60 overlap with each other. Reference symbol 76 represents an ultrasonic cleaning apparatus with a drying function, which is configured to perform ultrasonic cleaning treatment and drying treatment for the unprocessed roll R. The ultrasonic cleaning apparatus 76 with a drying function is provided in proximity to the roll transfer placement table 74.

The ultrasonic cleaning apparatus 76 includes a reservoir configured to store cleaning water, and an ultrasonic transducer provided below the reservoir. The ultrasonic cleaning apparatus 76 is capable of performing cleaning by vibrating the cleaning water through ultrasonic vibration of the ultrasonic transducer. A drying function is further provided to the ultrasonic cleaning apparatus 76 with a drying function. The ultrasonic cleaning apparatus 76 with a drying function is capable of performing ultrasonic cleaning and drying for each processing when necessary.

The fully automatic gravure cylinder manufacturing system 50 is electrically controlled by a computer 78. The first industrial robot 56 and the second industrial robot 60 are also controlled by the computer 78.

Reference symbol 80 represents a developing apparatus configured to perform developing for the unprocessed roll R.

A first modular processing unit 82A, a second modular processing unit 82B, and a third modular processing unit 82C are provided in the processing room-B. Those modular processing units are modularized and standardized processing units similarly to the above-mentioned modular processing unit 10.

The first modular processing unit 82A includes an etching apparatus 84, which is positioned on a lower stage as a first processing module, and a resist removal apparatus 86, which is positioned on an upper stage as a second processing module.

The second modular processing unit 82B includes a chromium plating apparatus 88, which is positioned on a lower stage as a first processing module, and is configured to perform chromium plating for the unprocessed roll R, and an electrolytic degreasing apparatus 90, which is positioned on an upper stage as a second processing module.

The third modular processing unit 82C includes a copper plating apparatus 92, which is positioned on a lower stage as a first processing module, and a nickel plating apparatus 94, which is positioned on an upper stage as a second processing module, and is configured to perform nickel plating for the unprocessed roll R.

Next, a configuration of the processing room-C is described. In the processing room-C, reference symbol 96 represents a paper polishing apparatus configured to perform paper polishing, and reference symbol 98 represents a grinding wheel polishing apparatus. As those apparatus, publicly known apparatus are applicable. For example, the paper polishing apparatus and the grinding wheel polishing apparatus as disclosed in Patent Documents 1 to 3 may be used.

The processing room-A and the processing room-C are communicable to each other through the shutter 54, and the grinding wheel polishing apparatus 98 and the paper polishing apparatus 96 are arranged in the handling area of the first industrial robot 56.

In the example shown in the accompanying drawings, the processing room-A is provided as a clean room. The processing room-A and the processing room-B may be provided as clean rooms, respectively, when necessary.

Doors 102 and 104 are provided on a wall 100 of the processing room-A. Through the doors 102 and 104, a processed gravure cylinder subjected to plate-making is carried outside and an unprocessed roll (plate-making base material) is newly carried inside. A gravure cylinder G subjected to plate-making is placed on any one of the roll stock apparatus 62*a* and 62*b*, and is then carried outside. On the other hand, the unprocessed roll to be subjected to plate-making is placed on the other roll stock apparatus. The computer 78 is installed outside the processing room-A so as to check and manage various kinds of information, to perform settings for various kinds of programs, and to control the fully automatic gravure cylinder manufacturing system 50.

In the example shown in the accompanying drawings, the unprocessed roll R is placed on the roll stock apparatus 62*a*, whereas the gravure cylinder G subjected to plate-making is placed on the roll stock apparatus 62*b*.

As described above, the unprocessed roll R is gripped by each of the robotic arm 58 of the first industrial robot 56 and the robotic arm 66 of the second industrial robot 60 to be sequentially transferred to and processed by each of the modular processing units 82A, 82B, and 82C.

With the fully automatic gravure cylinder manufacturing system 50, the gravure cylinder can be manufactured more quickly, with lower power consumption, and at lower cost than in the prior art.

REFERENCE SIGNS LIST

10: modular processing unit, 12*a*, 12*b*: frame member, 14: first processing bath module, 16: first beam module, 18*a*, 18*b*: chuck cone, 20: first chuck module, 22: first processing module, 24: second processing bath module, 26: second beam module, 28*a*, 28*b*: spindle portion, 30: second chuck module, 32: second processing module, 34, 206: storage tank, 36*a*, 36*b*: slide rail, 38*a*, 38*b*: frame portion, 40: energization metal member, 42: bus bar, 43: clamp, 44: electric cable, 46, 48, 208, 210: lid portion, 50: fully automatic manufacturing system, 52, 53: wall, 54: shutter, 56: first industrial robot, 58, 66: robotic arm, 60: second industrial robot, 62*a*, 62*b*: roll stock apparatus, 64, 68: chuck means, 70: photosensitive film coating apparatus, 72: laser exposure apparatus, 74: roll transfer placement table, 76: ultrasonic cleaning apparatus with drying function, 78: computer, 80: developing apparatus, 82A, 82B, 82C: modular processing unit, 84: etching apparatus, 86: resist removal apparatus, 88: chromium plating apparatus, 90: electrolytic degreasing apparatus, 92, 202: copper plating apparatus, 94: nickel plating apparatus, 96: paper polishing apparatus, 98: grinding wheel polishing apparatus, 100: wall, 102, 104: door, 204: degreasing apparatus, 200: prior art processing unit, A, B, C: processing room, G: gravure cylinder, R: unprocessed roll.

The invention claimed is:

1. A modular processing unit to be used for a fully automatic gravure cylinder manufacturing system comprising at least two industrial robots and a plurality of processing units installed within a handling range of each of the at least two industrial robots, the fully automatic gravure cylinder manufacturing system being configured such that an unprocessed roll is gripped by a robotic arm to be sequentially transferred to and processed by each of the plurality of processing units, the modular processing unit comprising:

a pair of frame members provided upright so as to face each other;

a first processing module comprising a first processing bath module configured to receive the unprocessed roll to perform plate-making processing, a first beam module provided horizontal to a floor and a first chuck module mounted on the first beam module, the first chuck module comprising a pair of chuck cones configured to grip both ends of the unprocessed roll so that the unprocessed roll is received in the first processing bath module; and a second processing module comprising a second processing bath module configured to receive the unprocessed roll to perform plate-making processing, a second beam module provided horizontal to the floor and a second chuck module mounted on the second beam module, the second chuck module comprising a pair of chuck cones configured to grip both the ends of the unprocessed roll so that the unprocessed roll is received in the second processing bath module, at least the first processing module and the second processing module being assembled onto the pair of frame members, wherein at least the first processing module and the second processing module define a multi-stage structure.

2. A modular processing unit according to claim 1, wherein at least one of the pair of chuck cones mounted on each of the first chuck module and the second chuck module is slidable relative to each of the first beam module and the second beam module so that the pair of chuck cones are freely brought closer to or away from each other.

3. A modular processing unit according to claim 1, wherein the each of the first chuck module and the second chuck module comprises frame portions, which are configured to support the pair of chuck cones, and are provided orthogonal to the each of the first beam module and the second beam module and horizontal to the floor, respectively.

4. A modular processing unit according to claim 1, wherein the pair of chuck cones of the each of the first chuck module and the second chuck module are rotatable through intermediation of spindle portions, respectively, and wherein the modular processing unit further comprises an energization metal member, which is brought into abutment against at least one of the spindle portions of the each of the first chuck module and the second chuck module, and is energizable with a current via a bus bar.

5. A fully automatic gravure cylinder manufacturing system using a modular processing unit, the fully automatic gravure cylinder manufacturing system comprising:

at least two industrial robots; and a plurality of the modular processing units installed within a handling range of at least one of the at least two industrial robots, the fully automatic gravure cylinder manufacturing system being configured such that an unprocessed roll is gripped by a robotic arm to be sequentially transferred to and processed by each of the plurality of the modular processing units, one or more of the modular processing units comprising a pair of frame members provided upright so as to face each other, a first processing module and a second processing module, said first processing module comprising a first processing bath module configured to receive the unprocessed roll to perform plate-making processing and a first beam module provided horizontal to a floor and a first chuck module mounted on the first beam module, the first chuck module comprising a pair of chuck cones configured to grip both ends of the unprocessed roll so that the unprocessed roll is received in the first processing bath module, said second processing module comprising a second processing bath module configured to receive the unprocessed roll to perform plate-making processing, a second beam module provided horizontal to the floor and a second chuck module mounted on the second beam module, the second chuck module comprising a pair of chuck cones configured to grip both the ends of the unprocessed roll so that the unprocessed roll is received in the second processing bath module, at least the first processing module and the second processing module being assembled onto the pair of frame members, wherein at least the first processing module and the second processing module define a multi-stage structure.

6. A method of manufacturing a gravure cylinder, the method comprising:

providing a fully automatic gravure cylinder manufacturing system comprising at least two industrial robots and a plurality of the modular processing units installed within a handling range of at least one of the at least two industrial robots, the fully automatic gravure cylinder manufacturing system being configured such that an unprocessed roll is gripped by a robotic arm to be sequentially transferred to and processed by each of the plurality of the modular processing units, one or more of the modular processing units comprising a pair of frame members provided upright so as to face each other, a first processing module and a second processing module, said first processing module comprising a first processing bath module configured to receive the unprocessed roll to perform plate-making processing and a first beam module provided horizontal to a floor and a first chuck module mounted on the first beam module, the first chuck module comprising a pair of chuck cones configured to grip both ends of the unprocessed roll so that the unprocessed roll is received in the first processing bath module, said second processing module comprising a second processing bath module configured to receive the unprocessed roll to perform plate-making processing, a second beam module provided horizontal to the floor and a second chuck module mounted on the second beam module, the second chuck module comprising a pair of chuck cones configured to grip both the ends of the unprocessed roll so that the unprocessed roll is received in the second processing bath module, at least the first processing module and the second processing module being assembled onto the pair of frame members, wherein at least the first processing module and the second processing module define a multi-stage structure;

using the fully automatic gravure cylinder manufacturing system.

7. A method, comprising:

using a fully automatic gravure cylinder manufacturing system to form a gravure cylinder, the fully automatic gravure cylinder comprising at least two industrial robots and a plurality of the modular processing units installed within a handling range of at least one of the at least two industrial robots, the fully automatic gravure cylinder manufacturing system being configured such that an unprocessed roll is gripped by a robotic arm to be sequentially transferred to and processed by each of the plurality of the modular processing units, one or more of the modular processing units comprising a pair of frame members provided upright so as to face each other, a first processing module and a second processing module, said first processing module comprising a first processing bath module configured to receive the unprocessed roll to perform plate-making processing and a first beam module provided horizontal to a floor and a first chuck module mounted on the first beam module, the first chuck module comprising a pair of chuck cones configured to grip both ends of the unprocessed roll so that the unprocessed roll is received in the first processing bath module, said second processing module comprising a second processing bath module configured to receive the unprocessed roll to perform plate-making processing, a second beam module provided horizontal to the floor and a second chuck module mounted on the second beam module, the second chuck module comprising a pair of chuck cones configured to grip both the ends of the unprocessed roll so that the unprocessed roll is received in the second processing bath module, at least the first processing module and the second processing module being assembled onto the pair of frame members, wherein at least the first processing module and the second processing module define a multi-stage structure.

* * * * *